US005125651A

United States Patent [19]

Keeling et al.

[11] Patent Number: 5,125,651

[45] Date of Patent: Jun. 30, 1992

[54] BASKETBALL TRAINING SYSTEM

[76] Inventors: Edward J. Keeling; Hans E. Keeling, both of 144 Hacienda Dr., Tiburon, Calif. 94920

[21] Appl. No.: 609,593

[22] Filed: Nov. 6, 1990

[51] Int. Cl.[5] ..... A63B 63/08

[52] U.S. Cl. ..... 273/1.5 R; 273/1.5 A; 273/402

[58] Field of Search ..... 273/1.5 R, 1.5 A, 402, 273/398, 399, 55 R, 396

[56] References Cited

U.S. PATENT DOCUMENTS

| | | | |
|---|---|---|---|
| 1,544,453 | 6/1925 | Harbison | 273/1.5 R |
| 2,039,794 | 5/1936 | Hayden | 273/1.5 A |
| 3,342,486 | 9/1967 | Farley | 273/1.5 A |
| 3,814,421 | 6/1974 | Spier, Jr. | 273/396 |
| 4,213,606 | 7/1980 | Wilson | 273/1.5 A |
| 4,936,577 | 6/1990 | Kington | 273/1.5 A |

FOREIGN PATENT DOCUMENTS

| | | | |
|---|---|---|---|
| 618199 | 2/1961 | Italy | 273/1.5 R |

*Primary Examiner*—Paul E. Shapiro

[57] ABSTRACT

The present invention is directed to a basketball training system including a first basketball hoop mounted at a predetermined elevation above a playing surface and a second basketball hoop mounted below the first basketball hoop and above said playing surface in a position such that a line representing the descending path of a desirably shot basketball will pass substantially through the centers of both of the basketball hoops.

7 Claims, 1 Drawing Sheet

BASKETBALL TRAINING SYSTEM

BACKGROUND OF THE INVENTION

The present invention relates to a system for use in playing basketball and more particularly the present invention provides for improving a shooter's touch by means of a system including a plurality of spaced apart basketball hoops located at predetermined locations above the playing surface.

Basketball is a game that involves shooting a basketball through an 18 inch hoop. Players become adapt at shooting by practicing shooting a ball through the basket or hoop. Heretofore it has been known to attempt to improve a player's shooting by practicing with a smaller than standard hoop, i.e. 16 inches, or by using a larger than regulation basketball. While either of these approaches may be of some help, there is still a need for providing a system which can be used to improve a player's skill while shooting at a conventionally baskethoop. The present invention is directed at providing such a system.

BRIEF DESCRIPTION OF THE INVENTION

The present invention is directed to a basketball training system which includes a first or upper hoop mounted at a predetermined elevation above the playing surface. This is usually 10 feet. A second or lower basketball hoop is mounted at a predetermined position above the playing surface and below the first hoop such that a line representing the downward flight path of a desirably shot basketball will pass substantially through the centers of both of the first and second hoops. A net having special features is provided for the upper hoop and the lower hoop may be provided with adjustable mounting means so that it may be moved to accommodate the downward flight path of other desirably shots from various locations of the playing surface.

OBJECT OF THE INVENTION

It is a particular object of the present invention to provide a basketball training system, which includes a pair of selectively spaced apart hoops adapted to help a shooter improve his shooting. Further objects and advantages of the present invention will become apparent from the following detached description read in view of the accompanying drawing, which is made a part of this specification.

DETAILED DESCRIPTION OF THE INVENTION

Figure 1:
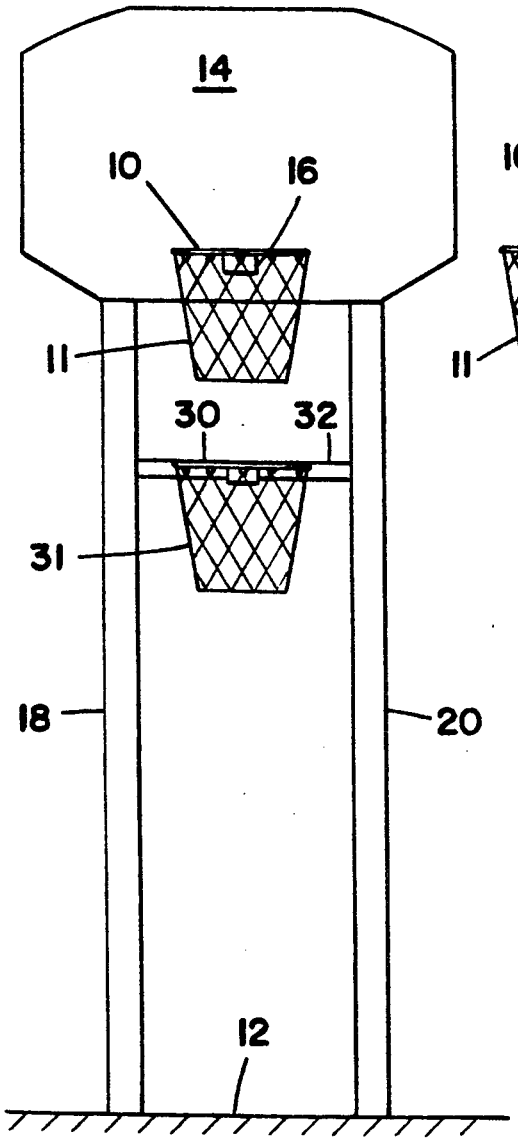
FIG. 1 is an elevation view illustrating an embodiment of apparatus assembled in accordance with the present invention.
Figure 2:
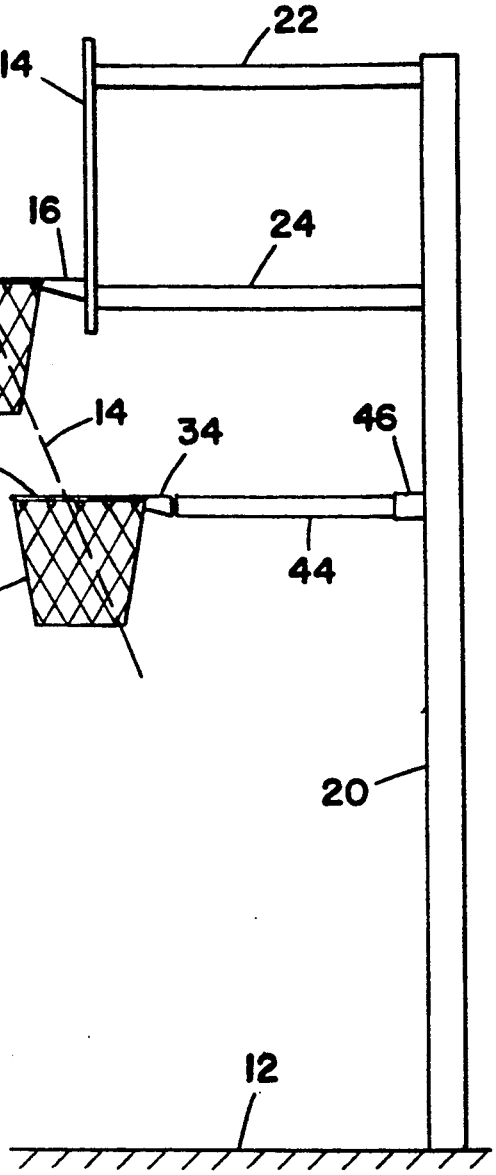
FIG. 2 is a side elevation view of FIG. 1.

Referring specifically to FIGS. 1 and 2, the basketball training system of the present invention will now be described in detail. A first basketball hoop 10 is mounted by suitable means at a predetermined elevation above a playing surface 12. For example the first hoop 10 is desirably connected to a backboard 14 by means of a flanged member 16 bolted to the backboard. The first basketball hoop 10 is commonly elevated 10 feet above the playing surface 12. Elongated posts 18 and 20 are useful to maintain the hoop 10 and the backboard at this desirable elevation. Extension stubs 22 and 24 are used to connect backboard 14 tot he posts 18 and 20.

A second basketball hoop 30 is mounted below the first basketball hoop 10 and above the playing surface 12. For example the second hoop 30 could be mounted on cross bar 32 by means of suitable bolted mounting flange 34. The second basketball hoop 30 is mounted in position below the first basketball hoop 10 such that a line 40 representing the descending path of a desirably shot basketball will pass substantially through the centers of both hoops 10 and 30. A desirably shot basketball will pass substantially through the centers of both hoops 10 and 30. A desirably shot basketball is one that is on line with the hoop and has sufficient arc to readily pass over the hoop. The most desirable descending path of a basketball will, of course, vary somewhat from shooter to shooter and may also vary within closer limits depending on the distance of the shot. The hoops 10,30 as shown in FIG. 3 are preferably mounted so that vertical cylinders passing through the hoops 10,30 would intersect and particularly so that the vertical cylinder representing the second (lower) hoop 30 would intersect the first (upper) hoop 10 within the back six inches of the first (upper) hoop 10.

A system has been constructed in accordance with the preferred embodiment of the present invention and has been found to give excellent results. The upper hoop 10 was elevated approximately 10 feet above the playing surface. Ten feet of course is the present official height of a basketball hoop. The lowerhoop 30 was positioned about 2 feet 8 inches below the upper hoop 30 and such that a line 14 representing the descending path of a desirable shot basketball passes through the centerline of both hoop 10 and 30. Also as shown in the topview of FIG. 3, the hoops 10, 30 overlapped, i.e. vertical cylinders intersected. The overlap distance was about 4 to 6 inches. As a practical matter the vertical distance between the first hoop 10 and the second hoop 30 could suitably be between 2 to 4 feet and more desirably $2\frac{1}{2}$ to 3 feet.

Both the first hoop 10 and the second hoop 30 should be provided with basketball nets 11 and 31 respectively. When nets are provided moreover it is critical in accordance with the present invention that the upper net 11 be selected or adapted to allow a basketball to pass through it without substantially altering the ball's descending path. Thus the upper net 11 should allow the ball to pass almost as if there was no net at all. This maybe done by selecting a very light net or by cutting or stretching a more standard net.

Figure 3:
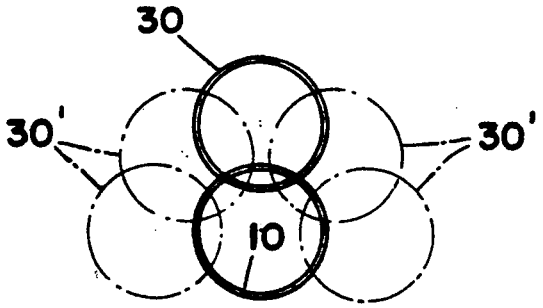
FIG. 3 is a top view of FIG. 1 with portions removed for clarity of presentation.
Figure 4:
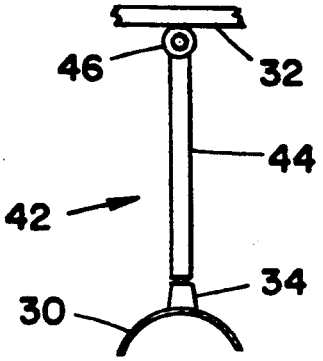
FIG. 4 is a view illustrating adjustable means for mounting the second basketball hoop in accordance with the present invention.

With particular reference to FIGS. 3 and 4 an adjustable mounting means 42 for the lower hoop 30 is shown. The adjustable mounting means includes a telescopic arm 44 capable of being extended and retracted a desired distance. The telescopic arc 44 is fixedly connected to the mounting flange 34 of hoop 30. Suitable locking means are provided to lock arm 44 at a desired extension. Locking arm 44 is pivotally mounted by suitable means 46 to the mounting means 32 for the second hoop. As illustrated in FIG. 3 the adjustable means permits the second hoop 30 to be repositioned such that a line representing the descending path of a second desirably shot basketball will pass substantially through the centers of the hoops 10, 30. Thus if less arc were desired the second hoop 30 could be moved back away from the first hoop 10 as shown in phantom in FIG. 3. Similarly if shots from the corner are practiced the second hoop 30 could be moved to the position shown in phantom to accomodate these shots.

The present invention provides a system for training basketball shooters. Thus when the hoops 10,30 are positioned as described herein a desirable shot is one that will "swish" through both hoops. The shot must have a good line; that is the direction that the ball travels must be directly at the front of the hoop or rim as viewed by the shooter. In addition to line, proper arc is also crucial to hitting a high percentage of shots. Thus thinking of arc in terms of what a ball would "see" when shot toward the basket, the views would vary from a straight line when shot with no arc to a full circle if shot so as to fall vertically into the hoop. Obviously the full circle gives the ball the best chance of going through the hoop. Even more obvious however a compromise must be reached to give the ball a downward path that maximizes it's chances of going through the hoop with the ability of the shooter to provide a repeatable shot with desirable arc. The present system allows a shooter to adjust the hoops 10, 30 to provide for the most desirable flight path and then to improve his shot by attempting repeated double swishes.

The system of the present invention also provides a setup which permits smaller kids and their dads or big brothers to play a very competitive one on one or two on two game. Thus the smaller kids use the second hoop 30 set at 6½ to 7½ feet while the dads depending on ability could score only on the first hoop 10 or only on double swishes through both hoops 10,30.

Although only specific embodiments of elements are described and illustrated in accordance with the system of the present invention the invention is not so limited and is meant to include all embodiments coming within the scope of the appended claims:

We claim:

1. A basketball training system comprising a first conventional basketball hoop, means fixedly mounting said first basketball hoop on a backboard at about 10 feet above a playing surface, a second basketball hoop, means fixedly mounting said second basketball hoop spaced apart from and about 2 to about 4 feet below said first basketball hoops and above said playing surface in a position such that a line representing the descending path of a desirably shot basketball will pass substantially through the centers of both said basketball hoops.

2. The system of claim 1 further characterized in that said second basketball hoop is mounted between about 2½ ft. to 3 ft below said first basketball hoop.

3. The system of claim 1 further characterized in that said means mounting said second basketball hoop includes an adjustable means for repositioning said second basketball hoop such that a line representing the descending path of a second desirably shot basketball will pass substantially through the center of said first basketball hoop and the readjusted second basketball hoop.

4. The system of claim 1 further characterized in that said first basketball hoop has a net operably connected thereto, said net selected to allow a basketball to pass through it without substantially altering it's descending path.

5. The system of claim 1 further characterized in that the first hoop and the second hoop overlap.

6. A basketball game for players of different heights and abilities comprising the steps of establishing an upper basketball hoop a predetermined elevation above the playing surface, establishing a lower basketball hoop below the upper basketball hoop and overlapping with said upper basketball hoop and in a position such that a line representing the downwardly flight of a desirably shot basketball would pass through the centers of both basketball hoops and scoring points by shooting a basketball through respectively the lower hoop and through the upper and lower hoops.

7. A method of improving the accuracy of a basketball shooter comprising fixedly mounting a conventional basketball hoop on a backboard at about 10 feet above a playing surface, fixedly mounting a second basketball hoop spaced apart from and between about 2 to about 4 feet below said conventional basketball hoop in a position such that a line representing the descending path of a desirably shot basketball will pass substantially through the centers of both of said basketball hoops and shooting a basketball at said basketball hoops.

* * * * *